United States Patent [19]

Schleinkofer

[11] 4,128,454

[45] Dec. 5, 1978

[54] SYSTEM AND METHOD FOR GAS PHASE PULP BLEACHING

[75] Inventor: Rudi W. Schleinkofer, Nashua, N.H.

[73] Assignee: Ingersoll-Rand Co., Woodcliff Lake, N.J.

[21] Appl. No.: 858,265

[22] Filed: Dec. 7, 1977

[51] Int. Cl.[2] ..... D21C 9/14; D21C 11/06

[52] U.S. Cl. ..... 162/49; 23/230 A; 55/18; 55/71; 162/62; 162/67; 162/236; 162/238; 162/DIG. 10; 203/3

[58] Field of Search ..... 162/49, 67, 238, DIG. 10, 162/63, 62, 17, 61, 236; 8/108.5, 156; 23/230 A, 253 A; 210/110; 55/18, 71; 203/1, 3

[56] References Cited

U.S. PATENT DOCUMENTS

| | | | |
|---|---|---|---|
| 3,486,971 | 12/1969 | Weyrick | 162/238 |
| 3,586,599 | 6/1971 | Yorston et al. | 162/67 |
| 3,729,375 | 4/1973 | Chappelle | 162/49 |
| 3,745,065 | 7/1973 | Rama | 162/67 |
| 3,814,664 | 6/1974 | Carlsmith | 162/236 |
| 3,963,561 | 6/1976 | Richter | 162/17 |
| 3,964,962 | 6/1976 | Carlsmith | 162/63 |

OTHER PUBLICATIONS

Danforth et al.; "Bleach Plant Computer Control" Tappi; vol. 58, No. 3; pp. 91–94.

*Primary Examiner*—Richard V. Fisher
*Assistant Examiner*—Steve Alvo
*Attorney, Agent, or Firm*—Frank S. Troidl

[57] ABSTRACT

Wood pulp is bleached with chlorine dioxide gas. The gas is obtained by feeding a chlorine dioxide solution to a stripper. Shredded or fluffed pulp is exposed to a controlled amount of chlorine dioxide gas for a time period sufficient to obtain the required pulp brightness. The amount of unused chlorine dioxide gas is continuously monitored. The controlled amount of chlorine dioxide gas fed to the bleaching system is automatically adjusted by controlling the amount of chlorine dioxide solution fed to the stripper in response to changes in the amount of unused chlorine doxide gas leaving the bleaching system.

2 Claims, 2 Drawing Figures

SYSTEM AND METHOD FOR GAS PHASE PULP BLEACHING

This invention relates to pulp bleaching. More particularly this invention is a new system and method for bleaching wood pulp with chlorine dioxide gas.

The process of bleaching fluffed or shredded pulp at high consistency with chlorine dioxide gas is a relatively new process. The process is described in U.S. Pat. No. 3,586,599, granted June 22, 1971 to F. H. Yorston et al. Commercially built systems for bleaching wood pulp with chlorine dioxide gas include apparatus adapted to recover unused chlorine dioxide which exits from the gas bleaching reactor. Serious control problems occur in attempts to recover the unused chlorine dioxide gas and such systems have proved to be impractical.

Also in previously built commercial systems, the operators controlled the charge of chlorine dioxide solution to a stripper on the basis of the bleached pulp brightness. Thus, the chlorine dioxide solution was controlled in accordance with the pulp brightness which the operator saw coming from the reactor. Because of pulp retention time in the system and testing time, this method has a lag time of from 1 to 1½ hours between action and result. Frequent variations in incoming pulp properties require frequent testing, and good control is hard to obtain.

Clearly there would be a definite advantage if a chlorine dioxide gaseous phase pulp bleaching system was available which did not include a complicated, expensive recovery system for recovering the unused chlorine dioxide gas and which insured maximum pulp brightness at all times with a minimum amount of testing work and dependence upon the operator's judgment. This invention provides the art of pulp bleaching with chlorine dioxide gas with the stated advantages. With this new method and system for chlorine dioxide gas phase pulp bleaching, the chlorine dioxide gas exiting from the reactor is recirculated back to the stripper for reuse. Also, the system provides an automatic control system which automatically adjusts the feed of chlorine dioxide gas to the bleaching means in response to changes in the amount of chlorine dioxide gas exiting from the reactor. Thus, the need for operator judgment and operator testing is kept to a minimum.

Briefly described my new method for bleaching wood pulp with chlorine dioxide gas comprises the steps of exposing shredded or fluffed pulp to a controlled amount of chlorine dioxide gas for a time period sufficient to obtain the required pulp brightness. The unused chlorine dioxide gas leaving the reactor is continuously monitored. The controlled amount of chlorine dioxide gas conducted to the bleaching means is automatically adjusted in response to changes in the amount of unused chlorine dioxide gas.

One method of obtaining the chlorine dioxide gas is to feed a chlorine dioxide solution to a stripper to convert the chlorine dioxide solution into materials including chlorine dioxide gas. The resulting chlorine dioxide gas is then fed to the bleaching system.

The unused chlorine dioxide gas exiting from the reactor may be recirculated back to the stripper for recycling. To control the amount of recirculated unused chlorine dioxide gas to the stripper, a chlorine dioxide gas analyzer is placed in the gas conduit leading from the stripper to the bleaching means. The amount of unused chlorine dioxide gas conducted back to the stripper is automatically adjusted in response to changes in the concentration of chlorine dioxide gas conducted from the stripper to the reaction area.

Briefly described the new system for bleaching wood pulp with chlorine dioxide gas comprises bleaching means including means for shredding or fluffing the pulp and exposing said pulp to chlorine dioxide gas for a time period sufficient to obtain the required pulp brightness. Means, of course, are provided for feeding the chlorine dioxide gas to the bleaching means, as well as means for removing the unused chlorine dioxide gas from the bleaching means. Means interconnect the chlorine dioxide gas feeding means and the unused chlorine dioxide gas removing means to automatically adjust the amount of chlorine dioxide gas fed to the bleaching means in response to changes in unused chlorine dioxide gas concentration.

The chlorine dioxide gas may be obtained by feeding a chlorine dioxide solution to a stripper. The chlorine dioxide solution fed to the stripper is controlled by a valve which in turn is controlled by the means for monitoring the unused chlorine dioxide gas exiting from the reactor. Thus, changes in the amount of unreacted chlorine dioxide gas leaving the reactor causes the control means to automatically adjust the valve in the chlorine dioxide feed conduit which in turn adjusts the amount of chlorine dioxide gas exiting from the stripper.

A gas analyzer may also be placed in the gas line interconnecting the stripper and the bleaching system. The gas analyzer is connected by means of an automatic control system to a valve located in the unused chlorine dioxide gas recirculating system leading from the gas reactor back to the stripper. With changes in concentration of chlorine dioxide gas fed to the bleaching system, the control system automatically adjusts the valve in the gas recirculation system.

The invention as well as its many advantages may be further understood by reference to the following detailed description and drawings in which.

Figure 1:
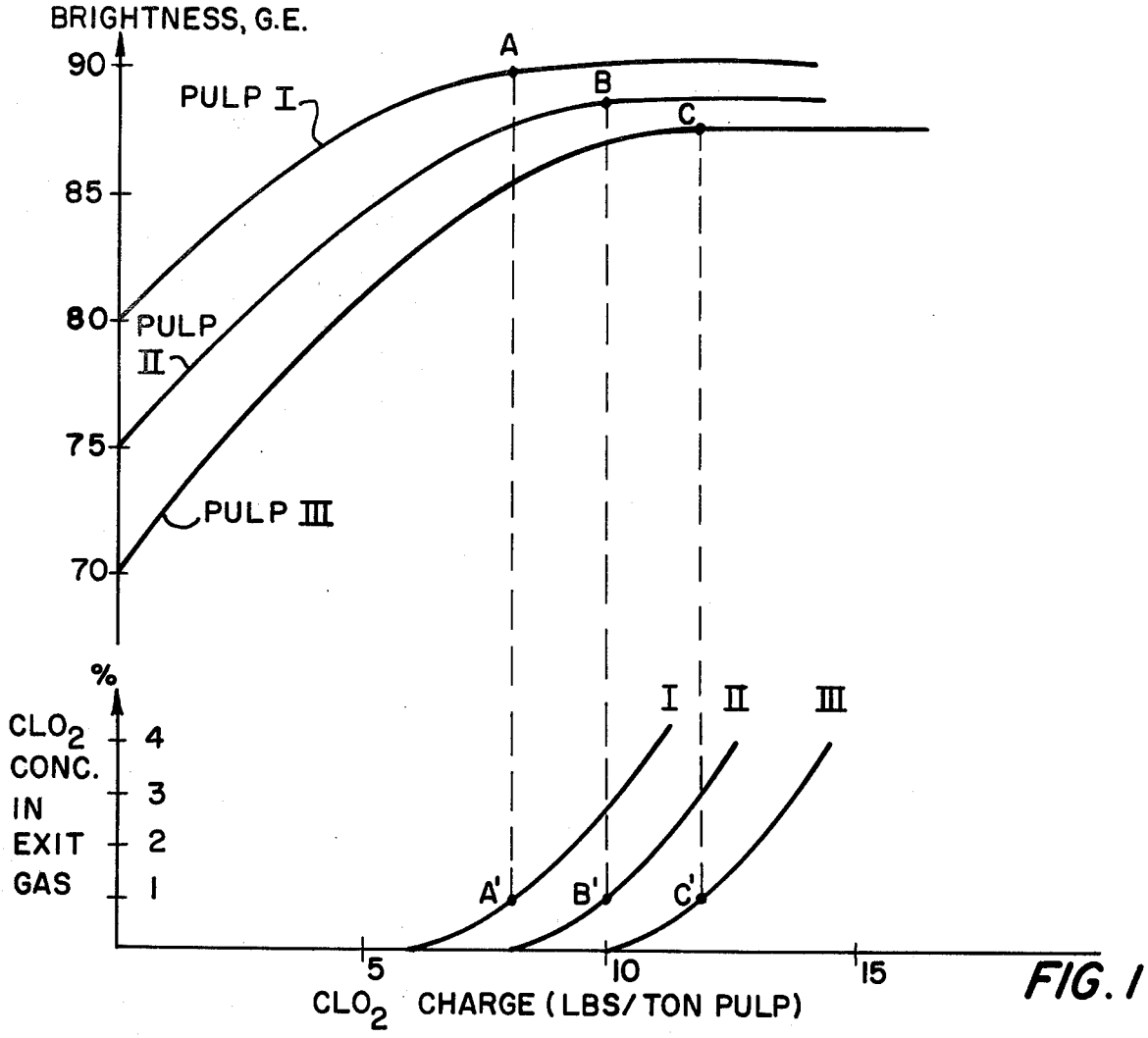
FIG. 1 is a graph useful in explaining the manner of operation and advantages of the invention.

A series of tests were performed during the operation of a commercial plant. Pulp brightness was determined before and after the bleaching at various charges of chlorine dioxide and gas analyses were made on the gas leaving the reactor. The graphs shown on FIG. 1 are typical results obtained.

As the chlorine dioxide gas entering the bleaching system is increased, the brightness of the bleached pulp increases and reaches a plateau, beyond which the bleaching cannot be driven even at much higher charge of chlorine dioxide gas. The level of the plateau depends on the brightness of the incoming pulp, as shown for three different pulps, I, II, and III in the graph.

Typical approximate concentrations of chlorine dioxide in the gas leaving the reactor is also shown in the graph. It is not possible to reach the brightness plateau without having chlorine dioxide in the exiting gas. At higher chlorine dioxide charges, the pulp does not consume more gas, shown by the increased concentration in the exiting gas.

Figure 2:
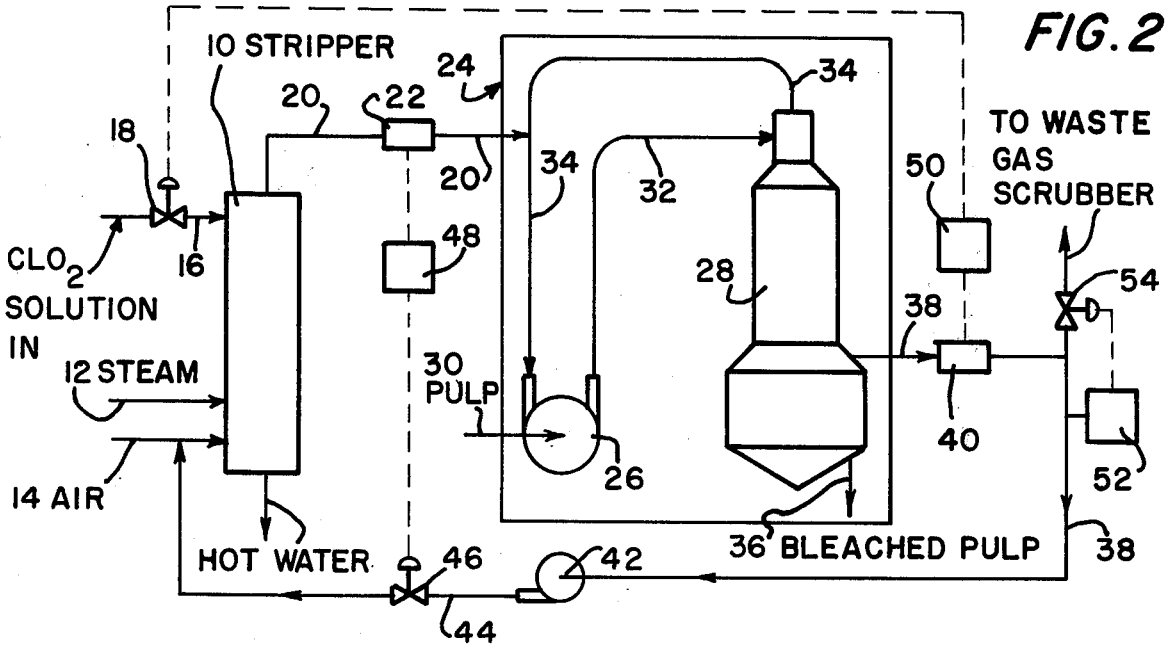
FIG. 2 is a schematic flow diagram illustrating one embodiment of the invention.

Referring to FIG. 2, the chlorine dioxide gas is produced from a water solution of 7 to 12 grams/liter strength by steam stripping in a packed column or stripper 10. The desired temperature of the produced gas of 170°-200° F. is controlled by the addition of steam to the stripper 10 by means of steam conduit 12. The concentration of chlorine dioxide in the gas leaving the stripper must be kept below about 12% by volume because the gas becomes unstable above this limit and decompositions become a safety hazard at higher concentrations. In order to dilute the gas, air is added to the stripper 10 by means of air conduit 14, the amount being controlled at a calculated volume based on the flow of chlorine dioxide solution, the strength, and the gas temperature.

The chlorine dioxide solution is fed to stripper 10 through chlorine dioxide solution conduit 16 controlled by valve 18. The chlorine dioxide gas produced in the stripper 10 is conducted by chlorine dioxide gas conduit 20 through a gas analyzer 22 which may be operated by the light absorption principal, to a bleaching system 24. The bleaching system 24 includes a pulp fluffer or shredder 26 and a reactor 28. The pulp shredder 26 and the reactor 28 may have a structure similar to the structure of the shredder and reactor shown in U.S. Pat. No. 3,814,664, granted June 4, 1974 to L. A. Carlsmith.

The wood pulp is fed to shredder 26 by means of pulp conduit 30. The pulp is shredded or fluffed into the form of fibres or fibre aggregates in the shredder 26 to obtain intimate contact with the chlorine dioxide gas resulting in fast reaction time, and then fed through line 32 to the top of the reactor 28. The diluted chlorine dioxide gas from line 20 is fed to the recirculating gas line 34 in bleaching system 24 and then through shredder 26, and line 32 to reactor 28. Thus, the wood pulp is initially exposed to chlorine dioxide in the shredder 26 to obtain the maximum benefit of the turbulence in the shredder. The wood pulp also reacts with the chlorine dioxide gas in the reactor 28 of the bleaching area 24. The residence time in the reactor 28 is a sufficient time period to obtain the required pulp brightness. Other conditions such as pH and temperature as specified in U.S. Pat. No. 3,586,599 granted June 22, 1971 to F. H. Yorston et al should be fulfilled in order to obtain maximum brightness.

The bleached pulp is fed from reactor 28 through line 36. After reacting with the pulp the unused chlorine dioxide gas along with air and water vapor is conducted from the reactor 28 by means of line 38. The gas (air, water vapor, and unused chlorine dioxide) is conducted through gas analyzer 40, blower 42, conduit line 44 controlled by valve 46, air conduit 14, and then fed back into the stripper 10.

The gas analyzer 22 continuously monitors the concentration of chlorine dioxide in the gas from the stripper 10. The signal from gas analyzer 22 is conducted to controller 48 which controls valve 46 in the gas circulation line 44 to control the flow of gas recirculating to stripper 10. An increase in concentration sensed by gas analyzer 22 will cause valve 46 to open and vice-versa.

The gas analyzer 40 continuously monitors the concentration of chlorine dioxide in the gas leaving the reactor.

Referring to FIG. 1 it can be seen that when the brightness plateau is approached, point A, B, or C for different pulps, the corresponding concentration of unused chlorine dioxide in the exiting gas will have reached a low but easily measurable value, point A', B', or C'. The concentration at this point will depend on the conditions chosen in the stripper 10 and the flow in the gas recirculation line 38. Generally the value will be in the 1% to 2% range. Hence, if the concentration of unused gas is kept in the 2% to 3% range, the pulp will always be exposed to sufficient amount of chlorine dioxide to reach optimum brightness.

The signal from gas analyzer 40 is used to control the flow of chlorine dioxide solution to the stripper 10 by means of a controller 50 and the control valve 18. The response of this control system will be quite fast because a change of $ClO_2$ solution charge will show a change at gas analyser 40 within two to three minutes. If, for instance, the pulp entering the system changes from type II to type III (FIG. 1), more chlorine dioxide gas will be absorbed in the bleaching system and the concentration at gas analyzer 40 will start to decrease. The control system will increase the opening in valve 18 and increase the charge to the stripper 10. At the same time valve 46 will increase the recycle flow to maintain a set concentration of chlorine dioxide gas going through gas analyzer 22. Within a few minutes, conditions will be restored to desired conditions. This compares to the case when the operator would not find out about the ongoing change until low brightness pulp came out of the reactor one hour too late to make proper changes.

A control system may be added to maintain proper pressure in the entire gas system. A small amount of air will enter with the pulp and a small amount of carbon dioxide is generated in the bleaching process. A corresponding amount of gas must be vented from the system and this can be done by means of a pressure sensor (not shown) in the gas recycle line 38, a controller 52 and a control valve 54. Suitably, the pressure in the recycle line 38 is kept slightly above atmospheric and the vented gas is led to a waste gas scrubber normally existing in any bleaching plant. The amount of gas vented will be very small compared to the amount recycled and the loss of chlorine dioxide will be very small.

A considerable reduction in steam and power usage is realized by this system. The heat content of the exiting gas is utilized for stripping and the steam consumption will correspond only to the heating of $ClO_2$ solution to the boiling point. The hot water produced is clean and can be used for other purposes in the mill. Power required in currently used commerical chlorine dioxide gas bleaching systems for water chilling, pumping of cooling water and weak solution has been eliminated and replaced by this new method and system by the power required by the blower 42 only.

Various modifications and changes in the apparatus shown in FIG. 2 may be made without changing the scope of applicant's invention as claimed. For example, the chlorine dioxide gas from line 20 may be fed to the line 32 leaving the shredder 26 rather than into line 34 going into the shredder 26. Also, if desired, the chlorine dioxide gas from line 20 may be fed directly to the reactor 28 so that the shredded or fluffed pulp is exposed to the chlorine dioxide gas only in the reactor 28.

I claim:

1. A method of bleaching wood pulp with chlorine dioxide gas comprising the steps of: feeding a chlorine dioxide solution to a stripper and converting in said stripper the chlorine dioxide solution into gases including chlorine dioxide gas; conducting the resulting gases to a reaction area and reacting said chlorine dioxide gas with pulp to bleach said pulp; recycling unreacted gases leaving the reaction area back to the stripper; continuously monitoring the concentration of unused chlorine dioxide gas in the gases leaving the reaction area; automatically adjusting the amount of chlorine dioxide solution fed to the stripper in response to changes in the unused chlorine dioxide gas leaving the reaction area;

continuously monitoring the concentration of chlorine dioxide gas in the gases conducted from the stripper to the reaction area; and automatically adjusting the amount of recycled unused gases conducted back to the stripper in response to changes in the concentration of chlorine dioxide gas conducted from the stripper to the reaction area.

2. A system for bleaching wood pulp with chlorine dioxide gas comprisng: a stripper for converting a chlorine dioxide solution into gases including chlorine dioxide gas; a pulp shredder for shredding pulp fed to the pulp shredder; a reactor in which the shredded pulp is bleached; means for feeding the chlorine dioxide solution into the stripper; valve means for controlling the amount of chlorine dioxide solution fed to the stripper; means for feeding the chlorine dioxide gas from the stripper to the shredder; means for feeding the shredded pulp and chlorine dioxide gas from the shredder to the reactor; a gas analyzer for monitoring the amount of unreacted chlorine dioxide gas leaving the reactor; means responsive to signals from the gas analyzer to automatically adjust said valve means to automatically adjust the amount of chlorine dioxide solution fed to the stripper in response to changes in unreacted chlorine dioxide gas leaving the reactor; means for recycling unreacted chlorine dioxide gas leaving the reaction area back to the stripper; recirculating valve means for controlling the flow of the unreacted chlorine dioxide gas back to the stripper; means for continuously measuring the amount of chlorine dioxide gas fed from the stripper to the shredder; and control means interconnecting the recirculating valve control means and the means for measuring the chlorine dioxide gas fed from the stripper to the shredder; said control means being automatically responsive to changes in concentration of chlorine dioxide gas fed from the stripper to the reactor to change the amount of unreacted chlorine dioxide gas recirculated back to the stripper.

* * * * *